US005118101A

United States Patent [19]

Belli

[11] Patent Number: 5,118,101

[45] Date of Patent: Jun. 2, 1992

[54] PLYOMETRIC EXERCISE PLATFORM

[76] Inventor: Raymond N. Belli, P.O. Box 3489, Truckee, Calif. 95734

[21] Appl. No.: 638,570

[22] Filed: Jan. 8, 1991

[51] Int. Cl.[5] ..... A63B 23/035

[52] U.S. Cl. ..... 482/52; 182/131; 482/142; 482/908

[58] Field of Search ..... 272/70, 70 A, 70.1, 272/70.2, 144, 114, DIG. 4; 248/125, 118.3, 118; 182/131 X, 132; 108/108, 106, 144

[56] References Cited

U.S. PATENT DOCUMENTS

| | | | |
|---|---|---|---|
| D. 232,242 | 7/1974 | Young | 272/70 X |
| 2,132,331 | 10/1938 | Wanamaker | 182/132 |
| 3,212,648 | 10/1965 | Baker, Jr. et al. | 108/108 |
| 4,390,011 | 6/1983 | Evans | 248/118 X |
| 4,620,701 | 11/1986 | Mojden | 272/144 X |
| 4,900,012 | 2/1990 | Fu | 272/70 X |
| 4,982,952 | 1/1991 | Wang | 272/70 |

FOREIGN PATENT DOCUMENTS

| | | | |
|---|---|---|---|
| 2110548 | 6/1983 | United Kingdom | 272/114 |

*Primary Examiner*—John G. Weiss
*Assistant Examiner*—L. Thomas
*Attorney, Agent, or Firm*—Richard C. Litman

[57] ABSTRACT

A platform for plyometric (jumping) exercises includes two horizontal platforms or steps of individually adjustable height. The steps are adjustably attached to a pair of uprights which extend upward from a base. The two uprights are parallel, about five feet long and one and a half feet apart. The uprights are formed of square section steel tubing. The steps include brackets which slide on the tubing and lock into various height positions by means of pins passed through holes in the tubing and brackets. A user may jump onto or off of the steps, or stand on them and exercise while holding a pair of handles which also attach to the uprights with pins.

4 Claims, 2 Drawing Sheets

PLYOMETRIC EXERCISE PLATFORM

FIELD OF THE INVENTION

The present invention relates to stationary platforms, stands, or benches for exercise in a standing position.

DESCRIPTION OF THE PRIOR ART

Numerous exercise platforms and devices are known in the prior art. They may be classified by the posture of the user. For example the exercise bench on which a person lies to "benchpress" weights is used lying down. Other machines such as rowing machines are used in a sitting position. The present invention is of the type used in a standing or squatting standing position only, such as walking or cross country ski machines.

Another example is disclosed in U.S. Pat. No. 3,628,791 of Garcia. This device is intended for stationary jogging. It comprises two paddle-like pedals which are hinged along a common horizontal axis at their forward ends. Each paddle is held up by a helical spring. Above the axis is a handle bar. A user stands with one foot on either pedal and grasps the handle, and "jogs" upon the pedals. The height of the pedals is not adjustable.

Champoux, in U.S. Pat. No. 3,747,924 teaches a variation on the concept of Garcia, by mechanically linking the pedals so that they move out of phase. Again, the pedal height is not adjustable.

U.S. Pat. No. 3,948,513 shows a general-purpose exercise bench which includes four upright members and two pairs of horizontal side rails. All the pieces meet at right angles; the rails are joined to the uprights so as to form a rectangle when the apparatus is viewed from above. A padded central beam runs between one pair of side rails. The user lies or sits upon the padded beam. The joints between the uprights and rails are made with the usual hole and pin attachments. The device also includes a triangulating cross member for stability.

Wilson, in U.S. Pat. No. 4,072,309, discloses an exercise device consisting of a base, a single upright of square section tubing, a bench attached to the upright and disposed above the base, and a handle also attached to the upright above the platform. The bench is supported at the end distal the upright by a support member; thus moving the end attached to the upright varies the angle of the bench. The handle is spring loaded for exercising by lying on the bench and pushing up against the handle. The device may also be used for other exercises by attaching weights to the handle, turning the bench sideways, etc.

None of the above inventions and patents, taken either singly or in combination, is seen to describe the instant invention as claimed.

SUMMARY OF THE INVENTION

The prior art does not disclose an exercise platform which is designed for jumping exercises. Neither does it show any device which allows standing and jumping exercises with adjustable height foot platforms or steps; nor does it show steps of individually adjustable height.

Accordingly, one object of the present invention is an exercise platform which allows exercises in which the feet are set at different heights.

Another object is an exercise platform which includes handles which can be set at different heights.

A further object is a platform adapted for plyometric leg exercises.

These and other objects of the present invention will become readily apparent upon further review of the following specification and drawings.

The present invention is a platform for plyometric (jumping) exercises. It includes two horizontal platforms or steps of individually adjustable height. The steps are adjustably attached to a pair of upright members which extend upward from a base. The two uprights are parallel, about five feet long and one and a half feet apart. The uprights are formed of square section steel tubing. The steps include brackets which slide on the tubing and lock into various height positions by means of pins passed through holes in the tubing and brackets. A user may jump onto or off of the steps, or stand on them and exercise while holding a pair of handle which also attach to the uprights with pins.

The invention is intended for plyometric leg exercises, which develop speed and explosiveness of muscle action.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
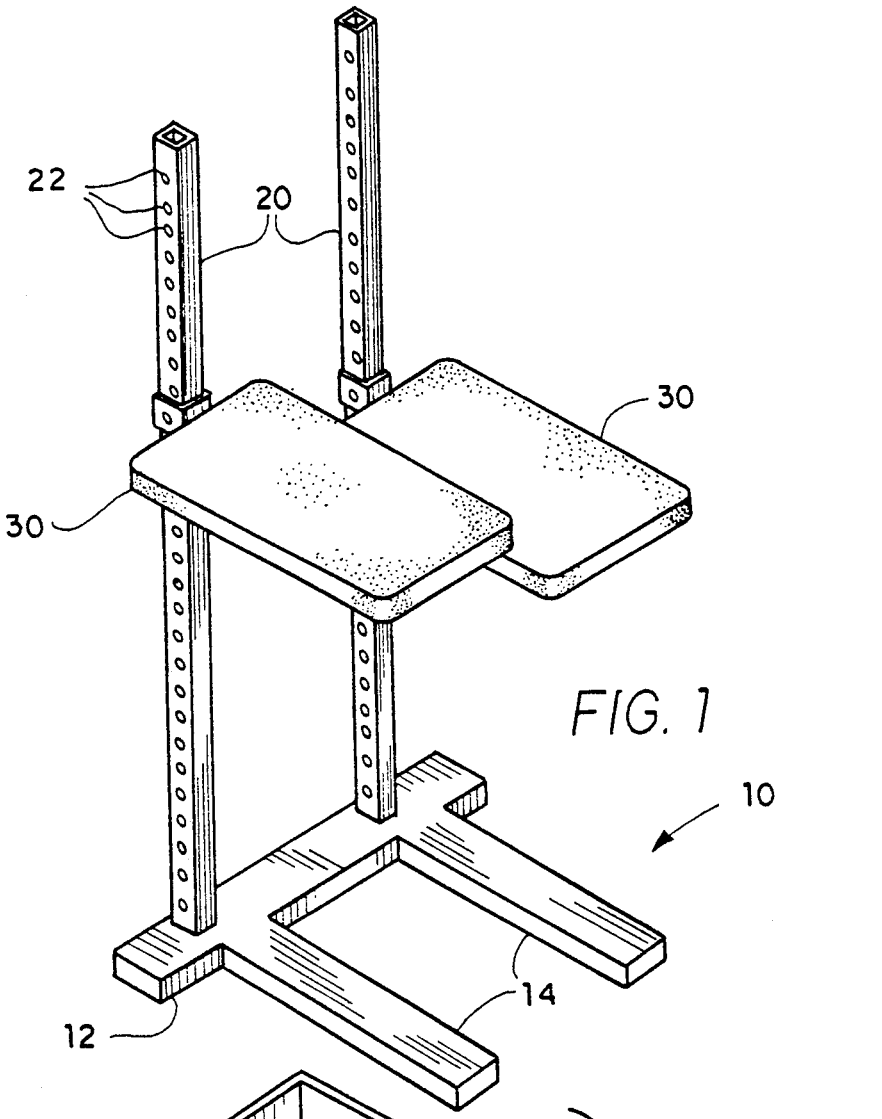
FIG. 1 is a perspective overview of the invention showing the base, uprights and steps.

The present invention, an exercise platform for jumping and other plyometric exercises, is shown in FIG. 1. A base 10 rests on a floor. Rising from the base 10 are two upright members 20. Steps 30 are adjustably fastened onto the uprights 20 to form individual foot supports whereupon a user may stand.

The base 10 is preferably welded together out of rectangular section steel tubing or channel. The base shown in the drawing consists of 6 inch by 2 inch tubing. It is composed of a back piece 12 and two extension pieces 14 welded to the back piece at right angles. This form of base provides a stable support.

The two uprights 20 are preferably box section steel tubing, 2 inches on a side, and about 5 feet long. The uprights are vertical, parallel, and set about a foot apart.

Holes 22 are drilled through both sides of the upright 20 at intervals of about 2 inches. These holes serve as attachments for the steps 30.

Each step 30, left and right, is a planar horizontal element large enough to stand on or jump onto easily, that is, approximately 1 foot by 2 feet. The steps are preferably made of 2 inch thick wood. When mounted on the uprights, the two rectangular steps are closely adjoint on one side.

Figure 2:
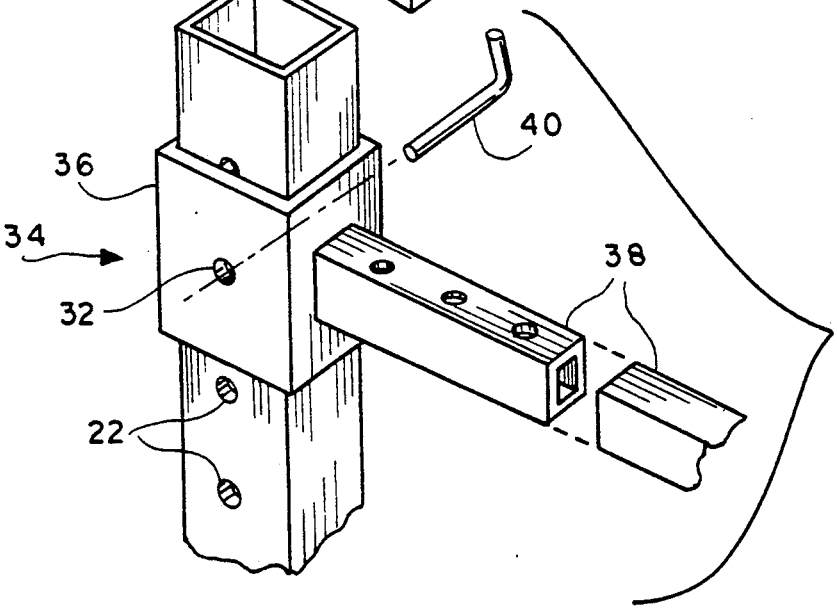
FIG. 2 is a detail perspective view of a step bracket adjustably mounted on an upright.

The attachment of a step to an upright is detailed in FIG. 2, which shows the step support bracket 34 which is disposed beneath the step 30. (The step bracket 34 is hidden from view in FIG. 1. In order to clearly show the step bracket 34 in FIG. 2, the step 30 has been eliminated from that view). The bracket 34 consists of a square section sleeve 36 which is slidably disposed over the upright 20, a support arm 38 extending from the sleeve, and two holes 32 through either side of the sleeve 36. The holes 32 align with the holes 22 through the upright 20 when the bracket 34 is in any one of a plurality of positions relative to the upright 20. A pin 40 is provided for each bracket 34 to penetrate a set of holes 22, 32 and lock the bracket 34 to the upright 20.

The positions of the steps are decided by the vertical placement of the holes 22. The holes 22 should be in corresponding pairs on the two uprights 20. The four holes on my corresponding pairs should be all on the same level, that is, at the same elevation, so that the left and right steps 30 may be set at the same height and be coplanar.

The step 30 may be attached to the bracket 34 by any convenient means, such as wood screws.

Figure 3:
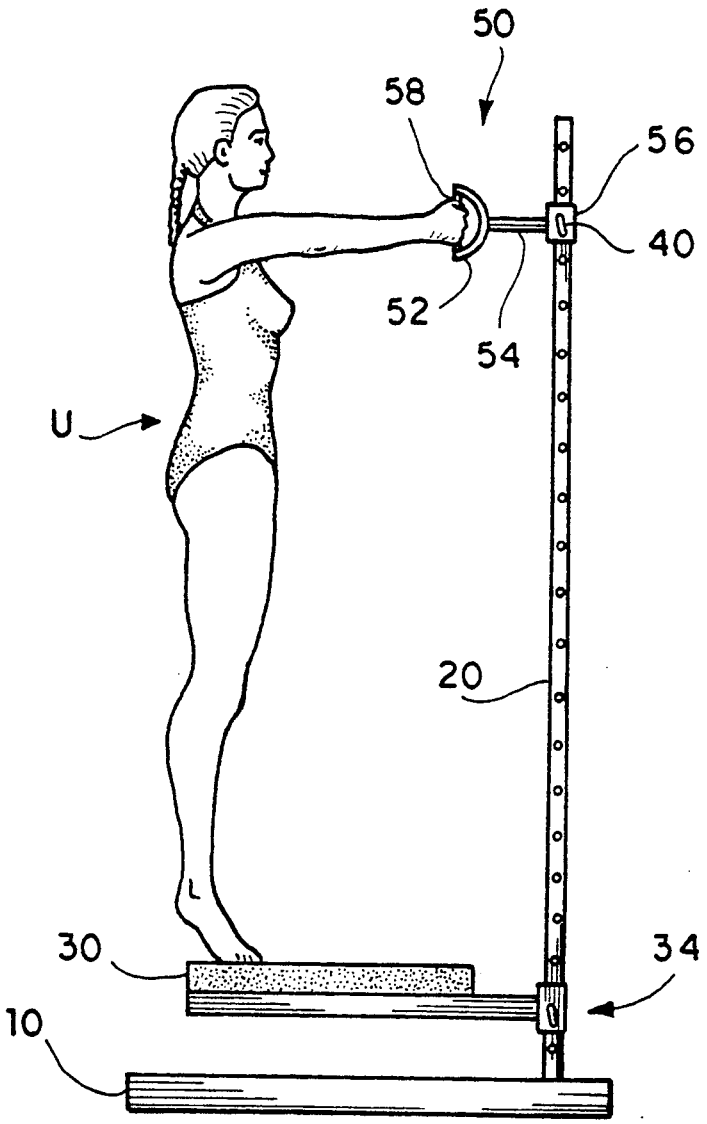
FIG. 3 is a side elevation view showing a user holding onto the handles while standing on the steps of the platform.

The present invention is shown in use for calf exercises in FIG. 3. A user U stands on the steps 20 which are set to equal heights by pinning the respective left and right step brackets 34 to corresponding pairs of holes on the left and right uprights. To stabilize herself, the user grasps handles 50 while rising and lowering herself on the steps 30.

Each handle 50 consists of a handle sleeve 56 similar to the bracket sleeve 36, which slides up and down on the upright 20 and locks thereto by means of a pin 40. Extending from the handle sleeve 56 is an arm 54 which terminates in a guard 52 and a grip 58. The arm 54 provides proper spacing of the handle grip 58 from the upright 20.

Each step 30 is adjustable from roughly 6 inches to about 5 feet off the floor. The present invention is especially adapted to plyometric exercises such as jumping, which develop speed and explosive extension of the muscles. With the handles, more exercises are possible.

When one of the two steps 30 is set at a height above 24 inches for jumping from that step, the other step 30 may be set at an intermediate height for easy stepping to the first step 30.

It is to be understood that the present invention is not limited to the sole embodiment described above, but encompasses any embodiments within the scope of the following claims.

I claim:

1. An exercise platform comprising:

a base adapted to rest upon a horizontal surface;

a vertically upright left member joined to said base, said member including a plurality of positions disposed along the length of said left member;

means for supporting a left foot, including a first sleeve embracing said upright left member and slidable therealong, a first support arm extending outwardly from said first sleeve and a generally planar horizontal left support surface affixed upon said first support arm;

first means for holding said left foot support means at one of said positions;

a vertically upright right member joined to said base, said member including a plurality of positions disposed along the length of said right member;

means for supporting a right foot, including a second sleeve embracing said upright right member and slidable therealong, a second support arm extending outwardly from said second sleeve, and a generally planar horizontal right support surface affixed upon said second support arm; and second means for holding said right foot support means at one of said positions.

2. An exercise platform as in claim 1 wherein said first left foot support means and said second right foot support means include holes in said left and right members and said first and second sleeves, and pins removably disposed through said holes to prevent relative motion of the supports and the members.

3. An exercise platform as in claim 1 including:

a left handle slidably attached to said left member;

third means for holding said left handle at one of said positions;

a right handle slidably attached to said right member; and fourth means for holding said right handle at another one of said positions;

4. An exercise platform as in claim 3 wherein said third means and said fourth means include holes in said left and right members and said left and right handles, and additional pins removably disposed through said holes to prevent relative motion of the handles and the members.

* * * * *